US009821245B2

(12) United States Patent
Larsen et al.

(10) Patent No.: US 9,821,245 B2
(45) Date of Patent: Nov. 21, 2017

(54) TOY BUILDING SET

(71) Applicant: LEGO A/S, Billund (DK)

(72) Inventors: Allan Westermann Larsen, Hillerød (DK); Klaus Elias Nielsen, Billund (DK); Per Frederiksen, Grindsted (DK); Erik Legernes, Vejle (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 14/394,706

(22) PCT Filed: Apr. 18, 2013

(86) PCT No.: PCT/DK2013/050114
§ 371 (c)(1),
(2) Date: Oct. 15, 2014

(87) PCT Pub. No.: WO2013/156037
PCT Pub. Date: Oct. 24, 2013

(65) Prior Publication Data

US 2015/0072588 A1 Mar. 12, 2015

(30) Foreign Application Priority Data

Apr. 18, 2012 (DK) ..... 2012 70201

(51) Int. Cl.
*A63H 17/00* (2006.01)
*A63H 33/08* (2006.01)
(Continued)

(52) U.S. Cl.
CPC ..... *A63H 33/088* (2013.01); *A63H 33/042* (2013.01); *A63H 33/086* (2013.01); *A63H 29/20* (2013.01)

(58) Field of Classification Search
CPC .. A63H 33/042; A63H 33/086; A63H 33/088; A63H 29/20
(Continued)

(56) References Cited

U.S. PATENT DOCUMENTS 2,410,409 A * 11/1946 Farmer ..... A63H 33/042 446/103
3,005,282 A * 10/1961 Christiansen ..... A63H 33/086 446/128
(Continued)

FOREIGN PATENT DOCUMENTS

CN 2592246 Y 12/2003
JP 5194333 S 8/1976
(Continued)

OTHER PUBLICATIONS

International Search Report for corresponding international application No. PCT/DK2013/050114, dated Aug. 21, 2013.
(Continued)

*Primary Examiner* — Melba Bumgarner
*Assistant Examiner* — Joseph B Baldori
(74) *Attorney, Agent, or Firm* — Day Pitney LLP

(57) ABSTRACT

A toy building set comprising at least two toy building elements of which the one toy building element is provided with one or more coupling means of first type, and the second toy building element is provided with one or more coupling means of second type that is/are configured to be complementary to said coupling means of first type to the effect that they can be interconnected to form a structure, wherein the second toy building element comprises a flywheel (10) which is rotatably mounted on the toy building element, wherein the flywheel comprises one or more actuator mechanisms (21); and wherein the coupling means and the complementarily configured coupling means are config-
(Continued)

ured such that the second toy building element can be mounted on the first toy building element in two or more different positions.

5 Claims, 15 Drawing Sheets

(51) Int. Cl.
*A63H 33/04* (2006.01)
*A63H 29/20* (2006.01)

(58) Field of Classification Search
USPC ..... 446/78, 93, 94, 95, 124, 429, 462
See application file for complete search history.

(56) References Cited

U.S. PATENT DOCUMENTS 3,224,135 A * 12/1965 Wright ..... A63H 33/086 23/301
3,234,683 A * 2/1966 Christiansen ..... A63H 17/262 446/103
3,464,147 A * 9/1969 Fischer ..... A63H 33/042 446/103
3,590,524 A * 7/1971 Beny ..... A63H 18/14 104/168
3,686,790 A * 8/1972 Winston ..... A63H 29/24 446/38
3,701,216 A * 10/1972 Smith, III ..... A63F 7/2472 185/39
3,733,742 A * 5/1973 Terzian ..... A63H 29/20 446/429
3,932,957 A 1/1976 Morrison et al.
3,975,858 A * 8/1976 Much ..... A63H 33/102 446/107
4,043,556 A * 8/1977 Lappa ..... A63B 67/00 273/445
4,375,139 A * 3/1983 Chatani ..... A63H 17/26 446/471
D282,090 S * 1/1986 Takahashi ..... D21/495
4,690,656 A * 9/1987 Friedman ..... A63H 33/042 446/424
D294,373 S * 2/1988 Bertrand ..... D21/495
D295,642 S * 5/1988 Olsen ..... D21/495
D295,649 S * 5/1988 Takahashi ..... D21/500
4,764,144 A * 8/1988 Lyman ..... A63H 17/14 446/124
4,919,639 A * 4/1990 Hesse ..... A47B 25/00 446/462
4,959,035 A * 9/1990 Murasaki ..... A63H 29/24 446/263
5,069,647 A * 12/1991 Zuviria ..... A63H 33/08 446/120
5,071,384 A * 12/1991 Poulsen ..... A63H 17/36 446/103
D325,052 S * 3/1992 Andersen ..... D21/495
D331,431 S * 12/1992 Jensen ..... D21/495
D344,305 S * 2/1994 Berggreen ..... D21/495
D344,552 S * 2/1994 Berggreen ..... D21/495
D346,629 S * 5/1994 Ruszkai ..... D21/495
5,310,376 A * 5/1994 Mayuzumi ..... A63H 33/04 446/107
5,312,283 A * 5/1994 Lyman ..... A63H 33/08 446/107
5,380,232 A * 1/1995 Berggreen ..... A63H 17/26 206/205
5,411,428 A 5/1995 Orii et al.
D364,657 S * 11/1995 Schmidt ..... D21/488
D365,756 S * 1/1996 Rask ..... D21/485
D389,408 S * 1/1998 Rask ..... D21/491
5,707,271 A * 1/1998 Kunz ..... A63H 33/042 446/128
D394,469 S * 5/1998 Nielsen ..... D21/500
D394,471 S * 5/1998 Frederiksen ..... D21/538
5,779,515 A * 7/1998 Chung ..... A63H 33/04 446/102
5,919,072 A * 7/1999 Pohlman ..... A63H 17/002 446/120
D412,725 S * 8/1999 Nielsen ..... D21/495
6,443,796 B1 * 9/2002 Shackelford ..... A63H 33/042 273/237
6,585,553 B1 * 7/2003 Fetridge ..... A63H 33/042 446/124
6,616,500 B1 * 9/2003 Harms ..... A63H 18/02 446/128
6,676,476 B1 1/2004 Lund et al.
D541,882 S * 5/2007 Petersen ..... D21/495
D574,442 S * 8/2008 Higuchi ..... D21/454
D597,150 S * 7/2009 Oikawa ..... D21/495
7,708,615 B2 * 5/2010 Munch ..... A63H 33/042 446/484
7,950,976 B2 * 5/2011 Bernstein ..... A63H 17/008 446/39
8,221,182 B2 * 7/2012 Seymour ..... A63H 33/04 446/120
D672,403 S * 12/2012 Riis ..... D21/493
8,388,405 B2 * 3/2013 Desent ..... A63H 17/008 446/429
8,568,191 B2 * 10/2013 Rehkemper ..... A63H 33/003 273/108
8,579,674 B2 * 11/2013 Carlson ..... A63H 17/26 446/429
8,696,401 B2 * 4/2014 Ichikawa ..... A63H 29/20 446/429
2005/0215172 A1 9/2005 Chen
2006/0099880 A1 * 5/2006 Laurienzo ..... A63H 17/006 446/247
2006/0148373 A1 * 7/2006 Vetuskey ..... A63H 17/008 446/73
2006/0211331 A1 * 9/2006 Trageser ..... A63H 29/24 446/429
2006/0252340 A1 * 11/2006 Bach ..... G09B 23/10 446/124
2011/0104981 A1 * 5/2011 Desent ..... A63H 17/008 446/435
2012/0309260 A1 * 12/2012 Coon ..... A63H 33/108 446/124
2013/0217294 A1 * 8/2013 Karunaratne ..... A63H 33/22 446/90
2013/0217295 A1 * 8/2013 Karunaratne ..... A63H 33/042 446/124
2014/0329436 A1 * 11/2014 Lennon ..... A63H 17/008 446/429
2015/0017870 A1 * 1/2015 Bird ..... A63H 17/264 446/124
2015/0182869 A1 * 7/2015 Karunaratne ..... A63H 33/042 446/91

FOREIGN PATENT DOCUMENTS

JP H03-129200 U 12/1991
WO 00/41790 A2 7/2000
WO 2004/058371 A1 7/2004

OTHER PUBLICATIONS

JPO's Notification of Reasons for Refusal, issued in corresponding Japanese application No. JP 2015-506099 Mar. 3, 2017. (Original and English Translation).

* cited by examiner

TOY BUILDING SET

CROSS-REFERENCE TO RELATED APPLICATIONS

This application is a U.S. National Stage of International Application No. PCT/DK2013/050114, filed on 18 Apr. 2013 and published on 24 Oct. 2013, as WO 2013/156037 A1, which claims the benefit of priority to Danish Patent Application No. PA 2012 70201, filed on 18 Apr. 2012.

The present invention relates to a toy building set comprising at least two toy building elements of which the one toy building element is provided with one or more coupling means of first type, and the second toy building element is provided with one or more coupling means of second type that is/are configured to be complementary to said coupling means of first type to the effect that they can be interconnected to form a structure.

BACKGROUND

Already, quite a lot of toys are available that comprise flywheels, and it is also known to use flywheels in toys to create various gyroscopic effects.

U.S. Pat. No. Re. 30,299 describes a toy car comprising a horizontally disposed flywheel capable of creating various gyroscopic effects on the toy car. While the flywheel rotates, the car may turn about its rear fender, topple onto two of its wheels and move forwards on two wheels until it topples onto all four wheels and moves further ahead.

U.S. Pat. No. 6,676,476 B1 describes a figure including a freely rotatable flywheel mounted within the figure such that the flywheel has a predetermined orientation. A pinion gear is secured to the flywheel and a guide post is positioned a distance away from the pinion gear to form a channel therebetween through which a rack gear can be used to rotate the flywheel and thereby move the figure. In different embodiments of the invention concerned, the vehicle may be eg a skateboard, a scooter, a bicycle, or a car.

US 2005/0215172 A1 shows a four-wheeled car. The car has a securely integrated wheel that is connected to the wheels and coupling stubs.

However, in many cases it is desirable to increase the scope for variations.

BRIEF DESCRIPTION OF THE INVENTION

It is therefore the object of the invention to provide a toy building set with toy building elements that increase the scope for play variations.

This is accomplished by the disclosures described above in that the second toy building element comprises a flywheel which is rotatably mounted on the toy building element, wherein the flywheel comprises one or more actuator mechanisms; and in that the coupling means and the complementarily configured coupling means are configured such that the second toy building element can be mounted on the first toy building element in two or more different positions.

An embodiment of the invention relates to one or more toy building elements comprising at least two different types of coupling means, such as coupling studs and complementary coupling means.

Hereby further scope for variations is accomplished.

According to an embodiment of the invention, the toy building element comprises a connecting structure and a building element, wherein the connecting structure structurally connects the flywheel and the building element.

According to an embodiment of the invention, the connecting structure extends from the axis of rotation of the flywheel past the periphery of the flywheel to the building element.

WO00/41790 discloses a toy building set comprising toy building elements, where a toy building element comprises a flywheel mounted in the building block.

According to an embodiment of the invention, the building element comprises a face, said face comprising one or more coupling studs and/or corresponding recesses. Hereby it is accomplished that the building element can be interconnected with toy building elements having complementary coupling means.

Hereby increased scope for variations is obtained for the use of a flywheel in a toy building set.

According to an embodiment of the invention, the toy building element having flywheel comprises means for engaging with an actuator means to thereby set the flywheel in motion, whereby the flywheel is caused to rotate freely.

According to an embodiment of the invention, the building element comprises at least one toothed wheel which is functionally connected to the flywheel, wherein the toothed wheel comprises means for coming into engagement with a rack to the effect that the toothed wheel can transmit movement from rack to flywheel whereby the flywheel is caused to rotate freely.

According to an embodiment of the invention, the plane of the face of the building element extends away from the axis of rotation in the direction defined by the direction of the connecting structure from the axis of rotation of the flywheel past the periphery of the flywheel.

Hereby it is accomplished that the flywheel has a directional axis of rotation relative to the remaining toy building elements, and consequently the flywheel has a predetermined orientation.

According to an embodiment of the invention, the plane of the face of the building element extends in parallel with the plane that extends through the axis of rotation of the rotatable flywheel.

Hereby it is accomplished that the flywheel has a directional axis of rotation relative to the remaining toy building elements.

According to an embodiment of the invention, the connecting structure comprises positioning means for positioning rack against toothed wheel.

Hereby correct position of rack is accomplished, and the positioning means also ensure that the complementary means on rack and toothed wheel, respectively, mesh in that the positioning means exerts a counter-pressure on the surface of the rack.

According to an embodiment of the invention, the flywheel is functionally connected to two toothed wheels.

Hereby the scope for variations is considerably increased.

According to an embodiment of the invention, the toothed wheel is connected to flywheel in a rotation-resistant manner whereby the rotation force of the toothed wheel is transmitted to the flywheel.

According to an embodiment of the invention, the toothed wheel and the flywheel are securely connected to each other and mounted on a turnable shaft. Hereby it is accomplished that the rotation force of the toothed wheel is transmitted directly to the flywheel.

According to an embodiment of the invention, the connecting structure comprises one or more coupling means for coupling to the shaft of the flywheel.

In the present description, the term 'flywheel' is to be construed in the sense of a flywheel being a mechanical device capable of maintaining kinetic energy in rotation during a short or long period. The flywheel will be capable of obtaining the gyroscopic effect where it requires much force to change the direction of the rotating body when it is in motion.

LIST OF FIGURES

An embodiment of the invention will now be explained in further detail with reference to the drawing, wherein.

DETAILED DESCRIPTION WITH REFERENCE TO THE FIGURES

The present invention relates to a toy building set comprising a toy building element 20 with a rotatable flywheel 10.

Figure 1A:
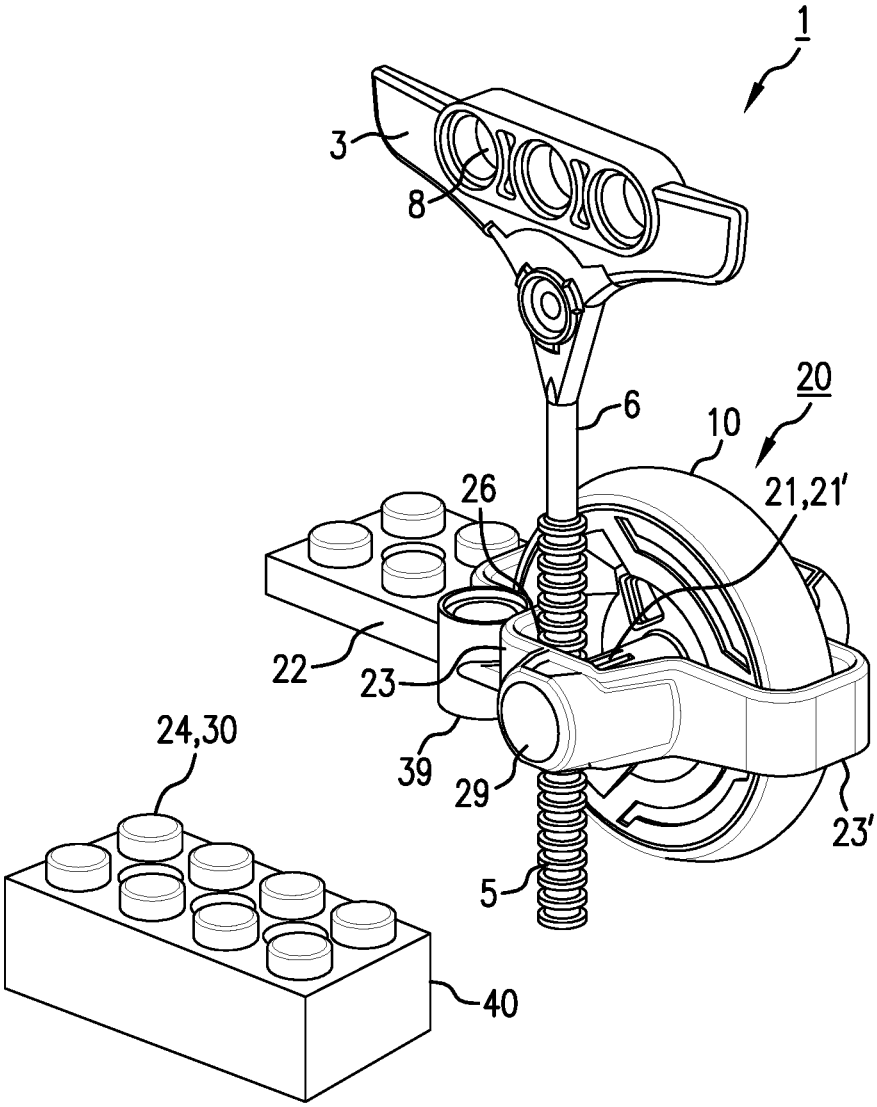
FIG. 1A is a perspective view of a toy building set with a toy building element having a flywheel according to the invention and a second toy building element, wherein the two toy building elements are not interconnected.
Figure 1B:
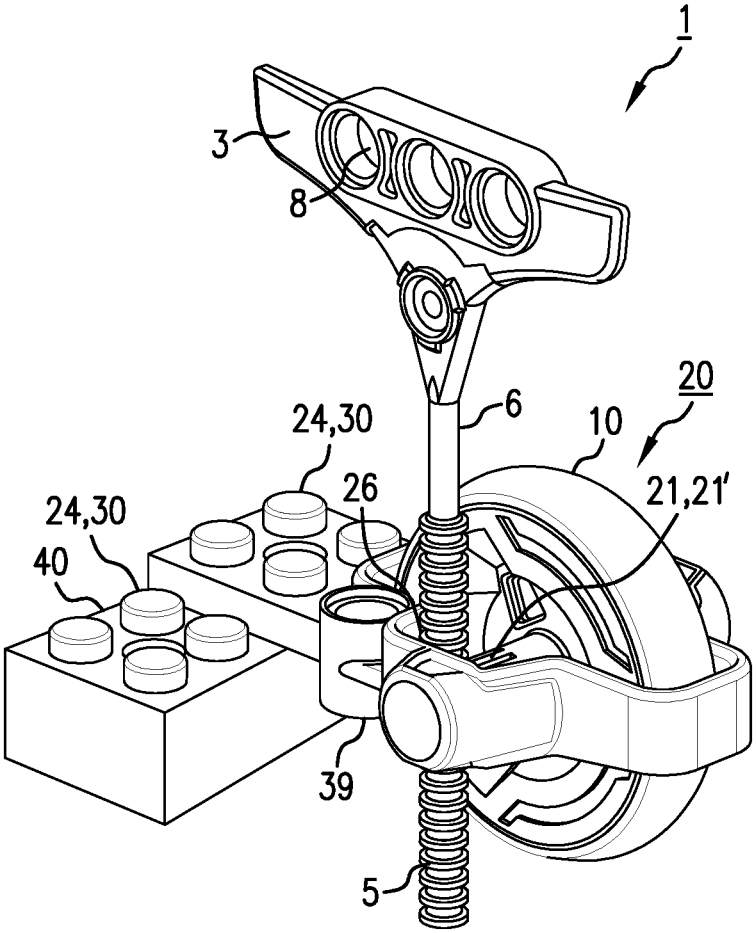
FIG. 1B shows the toy building set shown in FIG. 1A, wherein the toy building element having the flywheel and the second toy building element are coupled in a first manner.
Figure 1C:
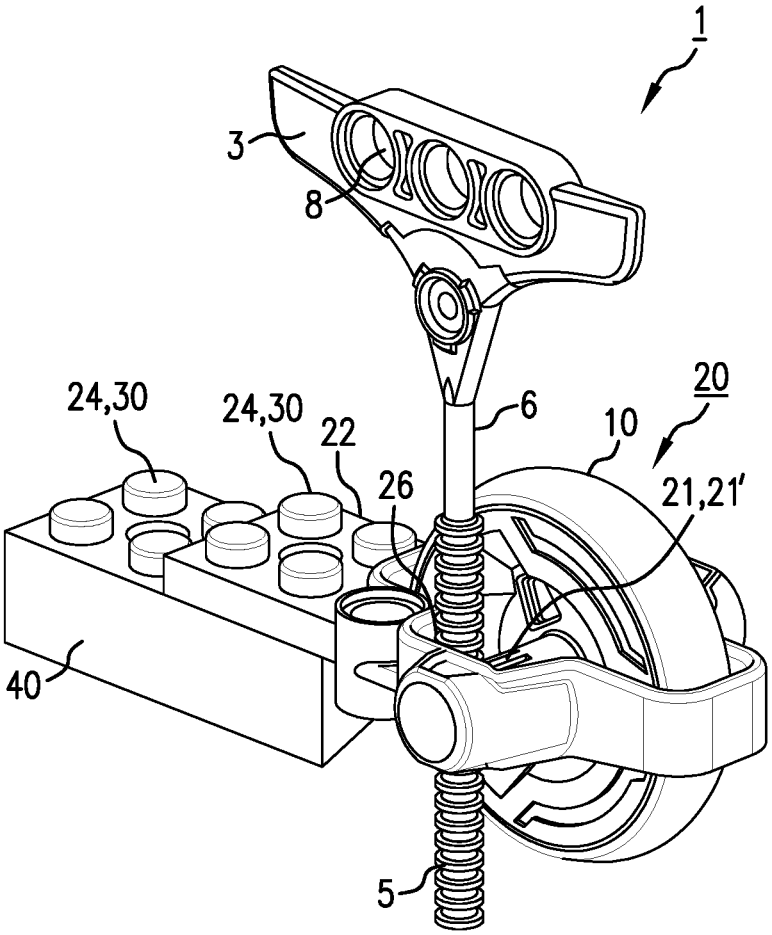
FIG. 1C shows the toy building set shown in FIGS. 1A and 1B, wherein the toy building element having the flywheel and the second toy building element are coupled in another manner.

FIGS. 1A-C illustrate a toy building element 20 comprising a flywheel 10.

The toy building element 20 is provided with one or more coupling means 24 that enable(s) mounting of the toy building element on at least one other toy building element 40 that comprises complementary coupling means. Thus, the toy building elements are capable of being interconnected to form a structure that is capable of constituting or partaking in a toy building set. In the example shown in FIGS. 1A-C, the toy building element 20 has several coupling means 24, 30. At least the one of the toy building elements in the toy building set comprise(s) several coupling means to ensure that the toy building elements can be interconnected in several ways. In the example shown in FIG. 1A, the toy building element 20 comprises coupling means 24 in the form of four studs formed on a building-element coupling part 22 and on the upper face 22' thereof. On the lower face 22" of the building-element coupling part 22, other coupling means (not shown) may be provided, eg recesses for receiving studs 30, like on the upper face 22'.

Figure 15:
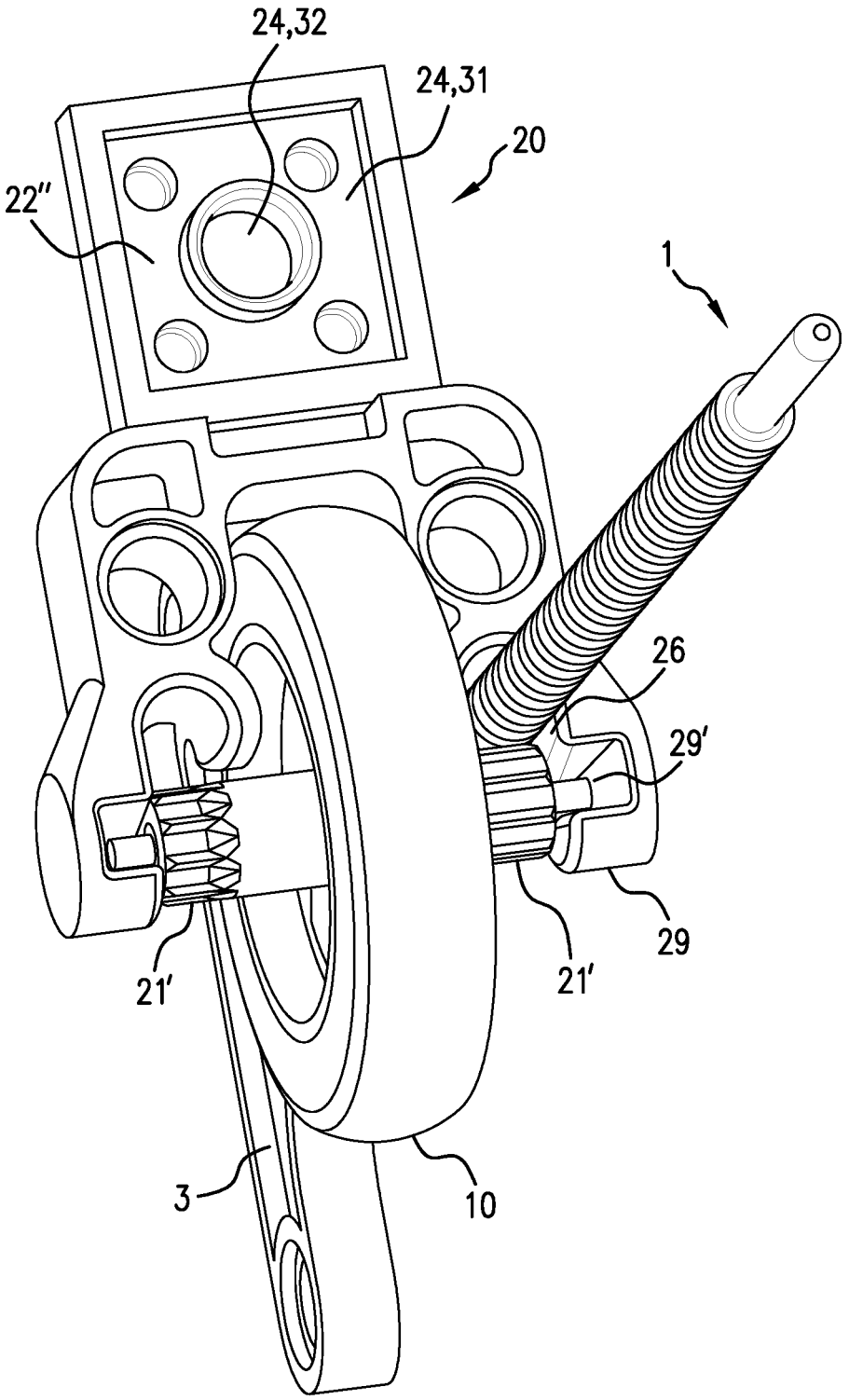
FIG. 15 shows yet an embodiment of the toy building element according to the invention.

According to one embodiment, a toy building element 20, 40 may comprise at least two different types of coupling means 24, eg coupling studs 30 and complementary coupling means, respectively, for receiving the coupling studs in the form knob-receiving recesses 31 as shown in FIG. 15. According to one embodiment, the coupling part 22 of the building element has coupling studs 30 configured on an upper face 22' and knob-receiving recesses 31 configured in the lower face 22". According to other embodiments (not shown), either coupling studs 30 or knob-receiving recesses 31 can be configured on/in one or both faces 22', 22". In other embodiments, other types of complementary coupling means 24 can be used, see below.

Figure 14:
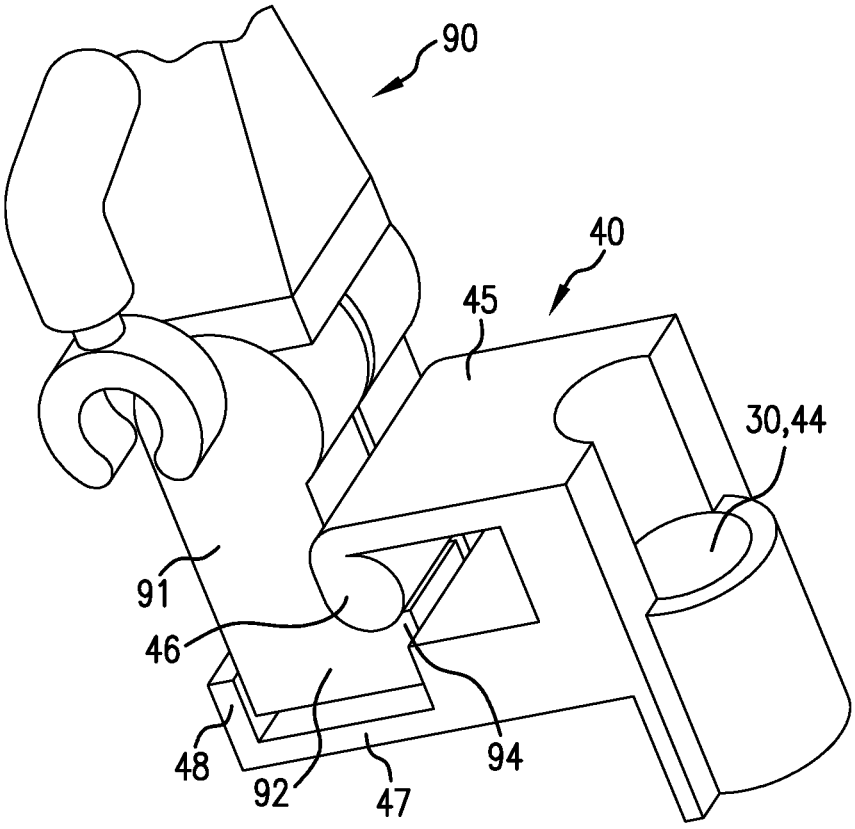
FIG. 14 shows an alternatively configured second toy building element that is capable of coupling to the toy building element having flywheel according to the invention and having a toy figure coupled to the second toy building element.

Thus, it is an option that the toy building element 20 comprising a flywheel can be mounted on another toy building element 40 in many different positions in order to thereby achieve different possible combinations and hence increased play options. This is shown in FIGS. 1A-C, the second toy building element 40, shown next to the toy building element 20 in uncoupled state in FIG. 1A, being coupled to the toy building element 20 in one manner in FIG. 1B, and in another manner in FIG. 1C. In the shown example, the second toy building element 40 is a simple box or a box-shaped structure with coupling means 24 in the form of studs 30 on one side and with coupling means in the form of knob-receiving recesses (not shown) on the opposite side. In other embodiments, the second toy building element 40 may be shaped in other ways. One example is shown in FIG. 14.

The toy building element 20 of FIGS. 1A-C may be coupled to the studs 30 on the toy building element 40 in that the coupling part 22 of the building element is configured with knob-receiving recesses 31 shown in FIG. 15.

The toy building element 20 comprises a flywheel 10. The flywheel comprises at least one actuator mechanism 21. In the example illustrated in FIG. 1, two actuator mechanisms 21 are provided. The actuator mechanisms 21 are configured as two toothed wheels 21' that are positioned with a toothed wheel to each side of the flywheel 10. The actuator mechanisms 21 are actuated by means of an actuator means which is depicted in FIG. 1 in the form of a rack 1. In other embodiments (not shown), a toothed wheel 21' may be arranged only to the one side of the flywheel 10.

The rack 1 comprises a grip/handle 3 and an elongate structure extending from the handle 3. The rack 1 comprises teeth 5 that are formed on the elongate structure and are capable of meshing with the teeth on a toothed wheel 21'. When the handle 3 is pulled, the movement of the rack 1 will actuate and hence rotate the toothed wheel 21' which transmits the rotary movement to the flywheel 10.

The toy building element 20 comprises a connecting structure 23 and a building-element coupling part 22. The connecting structure 23 connects the flywheel 10 and the building-element coupling part 22 to the effect that it is possible to couple the building element 20 having the flywheel 10 to other building elements with complementary coupling means, eg as shown in FIGS. 1B and 1C.

The connecting structure 23 extends from a position on the axis of rotation 25 of the flywheel past the periphery of the flywheel to the building-element coupling part 22. In the embodiments shown in FIGS. 1A-C, 2-4, 9, 11-13, and 16-17, the connecting structure forms a frame 80 that extends around the flywheel 10 in a plane that traverses the axis of rotation 25 of the flywheel. In the embodiments shown in FIGS. 5-8 and 15, the connecting structure 23 extends only in one direction from the axis of rotation 25 of the flywheel. In the embodiment of FIG. 15, the connecting structure 23 and the building-element coupling part 22 thus form a U-shaped construction around the periphery of the flywheel. In the embodiment shown in FIGS. 1A-C and 2-4, and in the embodiment shown in FIG. 9, the frame on the one side of the axis of rotation of the flywheel is merely a simple brace 23'.

The building-element coupling part 22 comprises at least one face 22', which face comprises one or more coupling means 24.

The building-element coupling part 22 may, as shown in the embodiments of FIGS. 1-4, 9, and 15, also comprise coupling means 24 in the form of a through-going hole 32 through the building-element coupling part 22. Cooperating coupling means (not shown) may be formed on the second toy building element 40, 50. As shown, that through-going hole 32 may be formed in combination with studs 30 and/or stud-receiving recesses 31. In other embodiments (not shown) such through-going hole 32 may be formed on the building-element coupling part 22 without studs 30 and/or stud receiving recesses 31 being also formed. Coupling means 24 in the form of a through-going hole 32 will allow the toy building element 20 having flywheel 10 to be coupled rotatably to the second toy building element 40.

The connecting structure 23 may also comprise one or more coupling means 39. Those coupling means 39 comprise both coupling studs, complementary coupling means for receiving coupling studs, recesses, or the like.

Thus, the connecting structure 23 and/or the building-element coupling part 22, and hence the toy building element 20, could be interconnected with one or more other toy building elements 40, 50 comprising complementary coupling means.

The toy building element 20 with the flywheel 10 comprises actuator mechanisms 21 (as shown in the form of toothed wheel 21') for meshing with an actuator means (as shown in the form of a rack 1) for causing the flywheel 10 into motion to the effect that the flywheel 10 rotates. The actuator means may be constituted of a rack 1 or the like capable of meshing with a toothed wheel 10.

In the shown embodiments as illustrated in the figures, the building element 20 comprises at least one toothed wheel 21' being functionally connected to the flywheel 10. The toothed wheel 21' and the flywheel 10 are structurally connected to the effect that the flywheel 21' is capable of transmitting a movement to the flywheel 10 whereby the flywheel 10 rotates freely.

FIGS. 1A-C illustrate that the toothed wheel 21' comprises complementary means (in the form of teeth) relative to the tines 5 of a rack 1. A pull movement in the rack 1 therefore enables translation of the movement into rotary movement from the toothed wheel 21' to the flywheel 10.

In preferred embodiments, the toy building element 20 is constructed symmetrically to the effect that there is a toothed wheel 21' to both sides of the flywheel 10. This will appear from FIGS. 2 and 15 that show an embodiment of the toy building element.

The toy building element 20 comprises a building-element coupling part 22, which building-element coupling part 22 comprises an upper face 22' comprising one or more coupling means 24.

In different embodiments of the toy building element 20, the plane which is defined by that face 22' may have different orientations relative to the flywheel 20 and the axis of rotation 25 of the flywheel.

FIGS. 1-4 illustrate an embodiment wherein the upper face 22' of the building-element coupling part 22 extends in extension of the connecting structure 23 away from the axis of rotation 25 of the flywheel, ie the plane coincides with a plane through the axis of rotation 25 of the flywheel and which comprises the axis of rotation 25 of the flywheel.

FIGS. 5-8 illustrate an embodiment wherein the face 22' of the building-element coupling part extends in a direction which is in parallel with a tangent to the periphery of the flywheel and comparatively perpendicular to the connecting structure.

The planes that are constituted by the faces 22' of the building-element coupling part in the two embodiments illustrated in FIGS. 1-4 and 5-8, respectively, are thus at right angles to each other.

However, it will be possible to have a construction for the toy building element where the plane of the expanse of the face 22' of the building-element coupling part is oriented differently than was shown in the two shown examples.

The connecting structure 23 of both embodiments, as shown in the figures, comprises positioning means or guides 26 in the form of a passage transversely through the connecting structure 23 in order to guide the actual meshing of the teeth 5 of the rack 1 with the teeth of the toothed wheel 21'. That guide 26 may be formed by a hole guiding the rack 1 to the effect that the rack 1 will be substantially perpendicular to the connecting structure 23 and/or the face 22' of the building-element coupling part when they engage, as it is illustrated in FIGS. 1-4 and 15.

Figure 8:
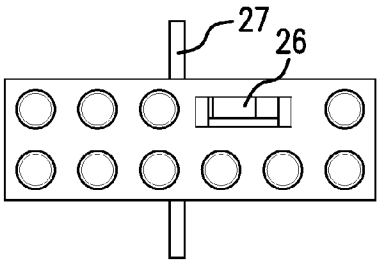
FIG. 8 shows the embodiment according to FIG. 5, seen from above.

However, the guide or positioning means 26 may also be a canal with tapering sides as illustrated in FIG. 8. Here the rack 1 forms an angle relative to the connecting structure 23 and/or the face 22' of the building-element coupling part when they engage, as illustrated in FIG. 8 where the angle is different from a right angle.

In the embodiments of the toy building element 20 shown in FIGS. 9, 11-13, and 16-17, a guide 26 for a rack 1 is formed, wherein the guide 26 is configured for allowing the rack 1 to be inserted through the frame 80 of the connecting element 23 longitudinally along the plane of the connecting element that extends through the axis of rotation of the flywheel 10 and comprises that axis. Thereby, in those embodiments, the rack 1 is conveyed at right angles to the direction in which it is conveyed in the embodiments shown in FIGS. 1-4, 9, and 15.

The flywheel 10 can be activated via activation of one or more activation mechanisms 21. FIG. 1 illustrates an embodiment wherein two toothed wheels 21' are provided, one toothed wheel 21' to each side of the flywheel.

Figure 5:
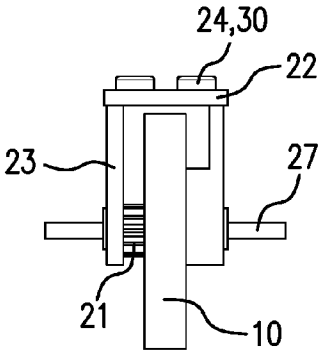
FIG. 5 illustrates an embodiment of the toy building element having a flywheel according to the invention.

FIG. 5 illustrates an embodiment in which one toothed wheel 21' is provided. In that embodiment, the toothed wheel 21' is connected in a rotation-resistant manner to flywheel 10 whereby the rotation force 21' of the toothed wheel is transmitted directly to the flywheel 10.

Thus, the flywheel 10 can be connected in a rotation-resistant manner to the toothed wheel 21'—either directly to the effect that the toothed wheel is a part of the flywheel, or via an axis of rotation 27.

It is possible to construct a rotatable flywheel 10 which is actuated by a rack 1 in other ways than the embodiments illustrated.

Therefore, the embodiments are to be perceived merely as two alternative options and are not to be construed as limiting as to how the connection between flywheel and the actuating rack can be constructed.

Figure 2:
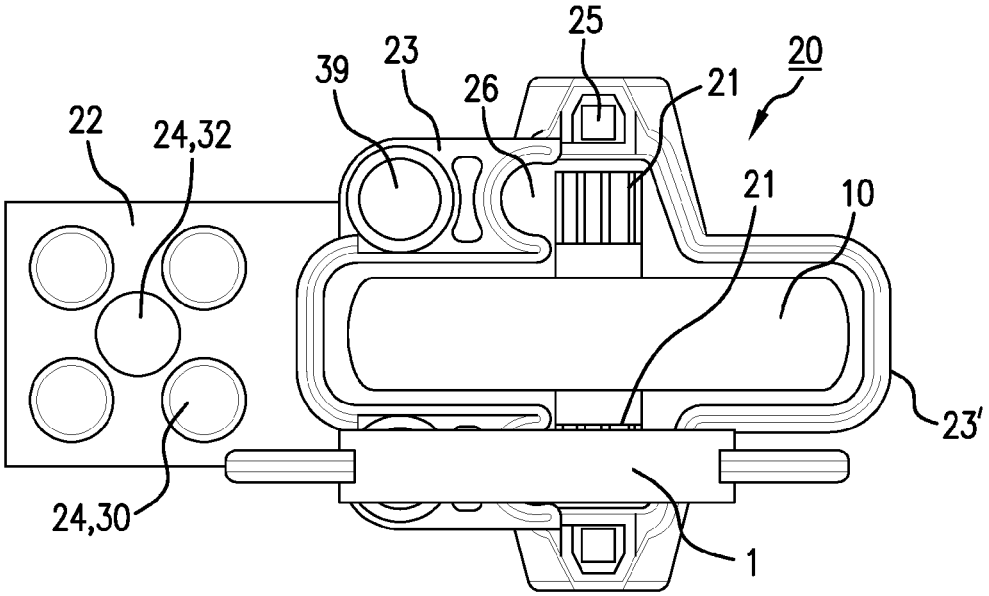
FIG. 2 illustrates, seen from above, the toy building element having flywheel as shown in FIGS. 1A-C and FIG. 2 in combination with an actuator means.
Figure 3:
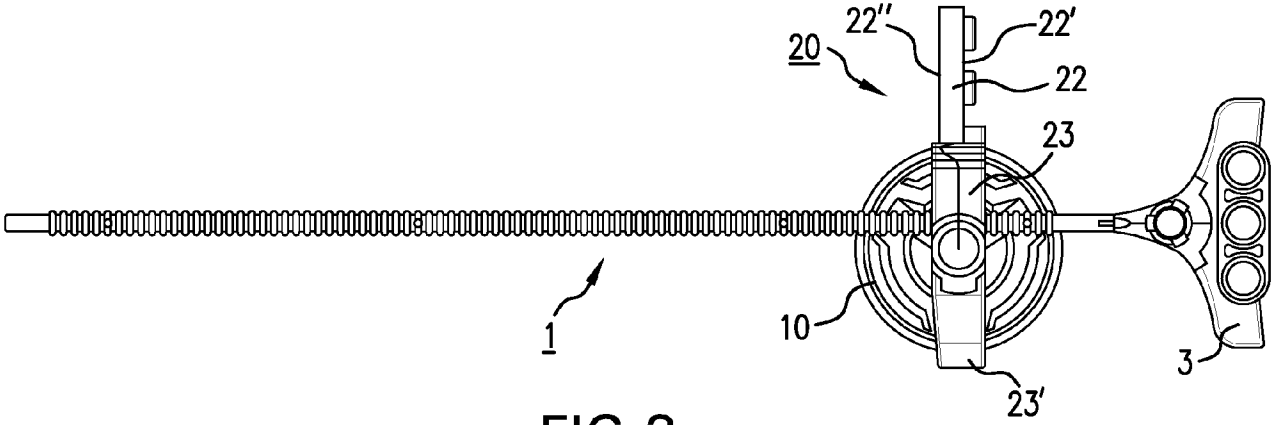
FIG. 3 illustrates the toy building element having a flywheel shown in FIG. 2 according to the invention, seen from the side.
Figure 4:
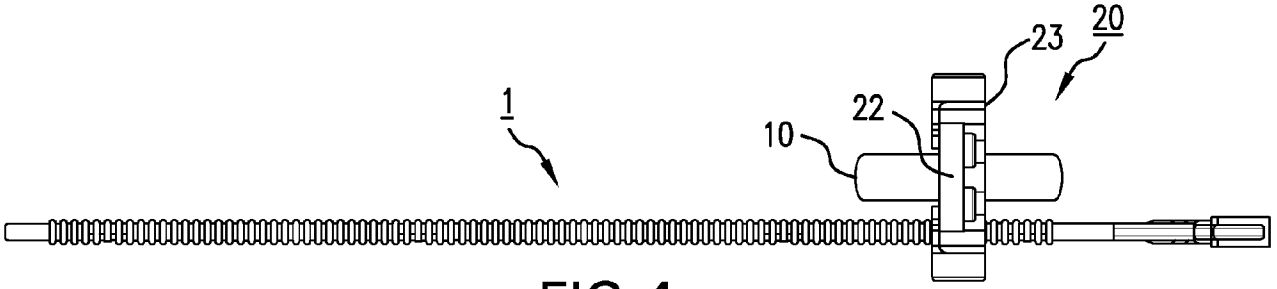
FIG. 4 illustrates the toy building element with a flywheel according to the invention, rotated 90 degrees relative to the toy building element having the flywheel illustrated in FIG. 3.
Figure 6:
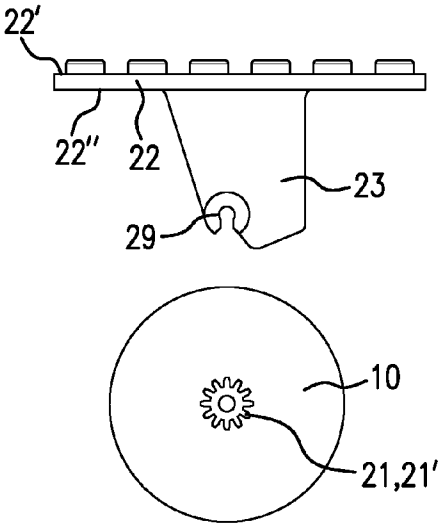
FIG. 6 illustrates the embodiment shown in FIG. 5 in an exploded view, seen from the side.
Figure 7:
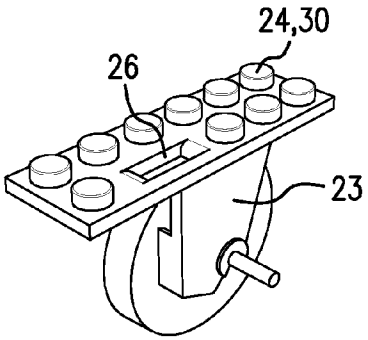
FIG. 7 illustrates the embodiment according to FIG. 5, seen in a perspective view.

The connecting structure 23 may be securely connected to a position on the axis of rotation 25 of the flywheel, as shown in FIG. 2, or the connecting structure 23 may comprise one or more shaft coupling means 29 for coupling to the shaft 27 of the flywheel as illustrated in FIGS. 6 and 7, which shaft coupling means 29 comprise a bearing 29' for rotatable attachment of the shaft of the flywheel.

The flywheel 10 is illustrated with a circular periphery, but the flywheel 10 may, in combination with the embodiments described above, also be configured with other shapes, eg an oval-shaped or an angled periphery.

Figure 9:
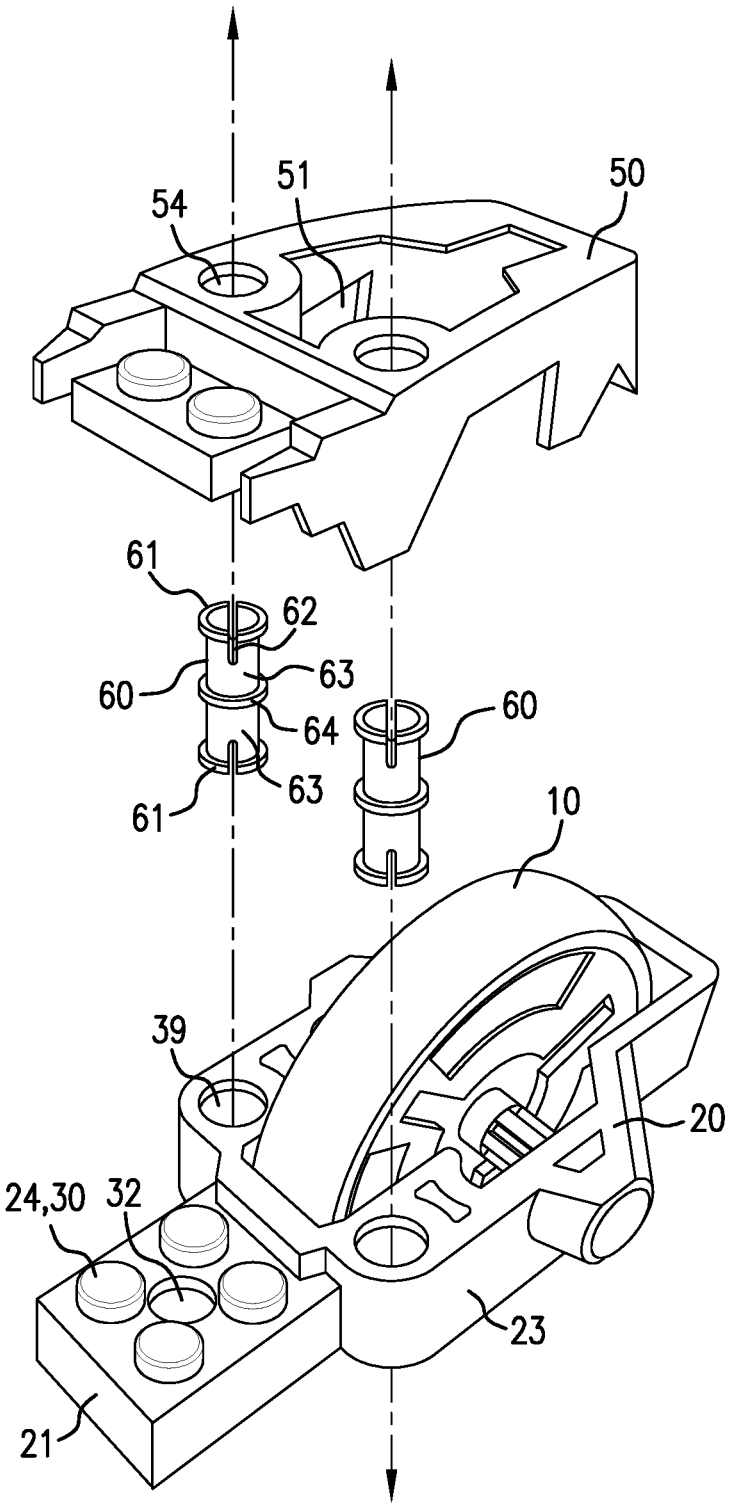
FIG. 9 illustrates, in an exploded view, an embodiment of the toy building element and a shell part that can be attached to the toy building element with mini-building elements.

FIG. 9 shows an embodiment of a toy building element 20. That toy building element is substantially the same as the toy building element 20 shown in FIGS. 1-4. In FIG. 9 it is shown that the toy building element 20 can be coupled to a shell element 50. In that case, the shell element 50 is coupled to the toy building element 20 by means of mini-building elements 60. The mini-building elements 60 cooperate with coupling means in the form of through-going holes 39 on the connecting element 23 and with coupling means in the form of through-going holes 54 on the shell element 50. In that case, the mini-building elements 60 are formed as substantially cylindrical structures 63 that, essentially centrally on the cylindrical structure 63, have a projecting encircling collar 64. Correspondingly, at both ends, a projecting encircling collar 61 is provided that enables the mini-building element 60 to form a detachable, but firmly locked connection with a through-going hole, such as eg through-going holes 39 on the connecting element 23 and through-going holes 54 on the shell element 50. One or more slots 62 is/are formed in the cylindrical structure 63. The slots 62 have the effect that the cylindrical structure 63 may act resiliently with a view to being capable of travelling through another coupling means in the form of a hole, such as eg through-going holes 39 on the connecting element 23 and through-going holes 54 on the shell element 50.

In alternative embodiments (not shown), a shell part 50 may be coupled to the connecting element 23 by means of complementary coupling means that are formed on shell part 50 and the connecting element 23, eg holes and pins or studs and stud-receiving recesses.

Figure 10:
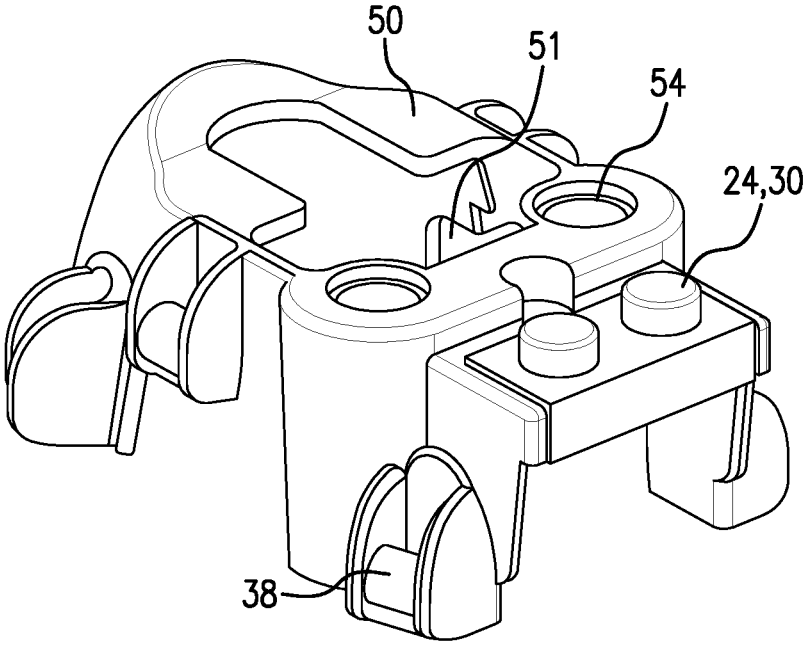
FIG. 10 illustrates, in a perspective view, an alternatively configured shell part for toy building elements according to the invention.

FIG. 10 shows an alternative embodiment of a shell part 50 for coupling to a toy building element 20. In addition to coupling means 54, that shell part 50 also has coupling means in the form of studs 30 and cylindrical coupling parts 38 that can be interconnected with complementary coupling means, eg in the form of U-shaped clamping coupling means (not shown).

In FIGS. 9 and 10, the shell part 50 is shown with a centrally through-going hole. That hole allows a rack 1 to be conveyed into the guide 26 order to enter into engagement with a toothed wheel 21'.

Figure 11:
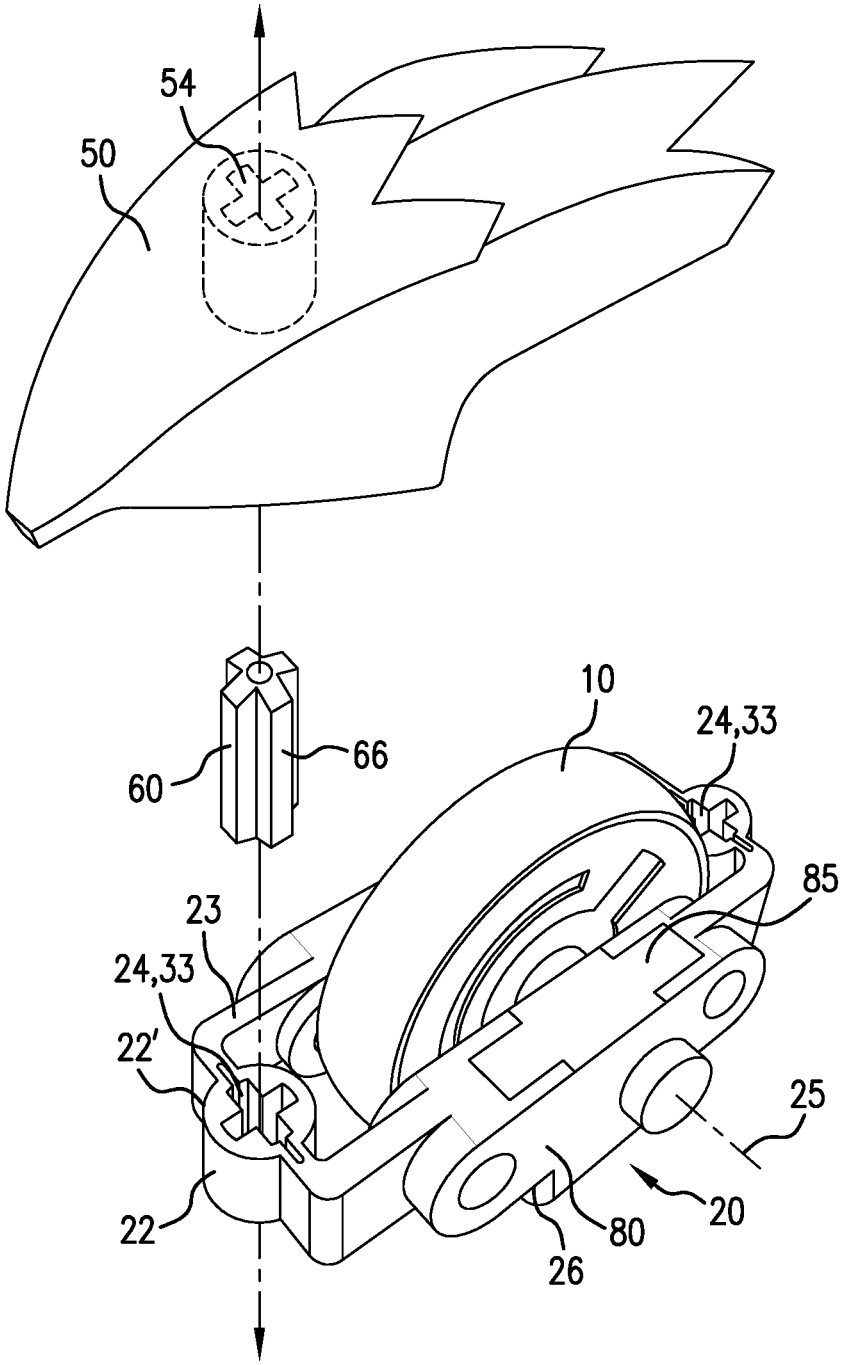
FIG. 11 shows, in an exploded view, yet an embodiment of the toy building element and with yet an alternatively configured shell part that can be attached to the toy building element by means of another type of mini-building elements than the ones shown in FIG. 9.

FIG. 11 shows an embodiment of a shell part 50 for interconnection with a toy building element 20 wherein there is no such through-going central hole 51. In that embodiment of the toy building element 20, the rack 1 is caused to travel through a guide 26, where the rack is moved in parallel with the plane which is formed by the surface of the building-element coupling part 22 which is connected to the axis of rotation 25 of the flywheel 10 and which extends substantially through the axis of rotation 25 of the flywheel 10.

In FIG. 11, the shell part 50 is not, as was shown in FIGS. 9 and 10, coupled to coupling means on the connecting part 23, but rather to coupling means 24, 33 on the building-element coupling part 22. In further embodiments (not shown), however, coupling means may be provided on the connecting structure 23, too, as described in the above embodiments.

In FIG. 11, the shell part 50 is coupled to the toy building element 20 by means of a mini-building element 60. The mini-building element 60 cooperates with coupling means 24 in the form of a through-going hole 33 with x-shaped cross-section on the building-element coupling part 22, and with coupling means in the form of through-going holes 54 with x-shaped cross-section on the shell element 50. In that case, the mini-building element 60 is made as a substantially elongate structure 66 with x-shaped cross-section. The mini-building element 60 and the coupling means 33, 54 may preferably be configured to form a close frictional engagement that allows a firm, but releasable interconnection.

The x-shaped, complementary coupling means 66, 54, 33 shown in FIG. 11 can replace or supplement the coupling means described above.

In FIG. 11, a building-element coupling part 22 is provided at both ends of the connecting structure 23, ie to both sides of the flywheel. In both building-element coupling parts 22, coupling means 24 are formed in the form of a through-going hole 33 with x-shaped cross-section. In other embodiments, different types of coupling means may be provided at each their end, or, if several coupling means are provided at each end, different combinations of types of coupling means 24.

Figure 12:
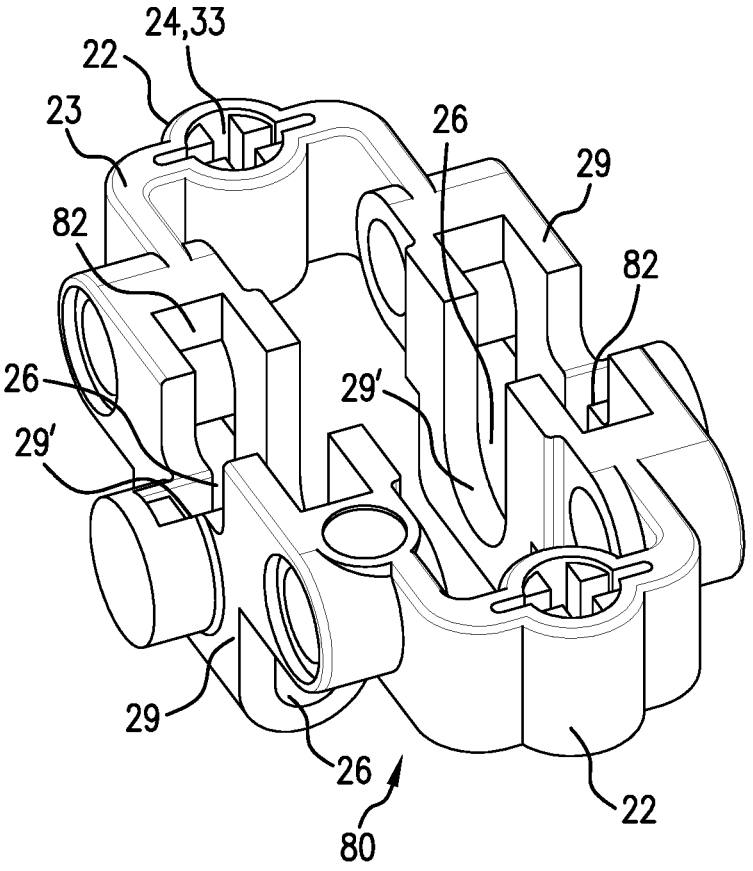
FIG. 12 illustrates, in a perspective view, a frame for the embodiment of a toy building element shown in FIG. 11.
Figure 13:
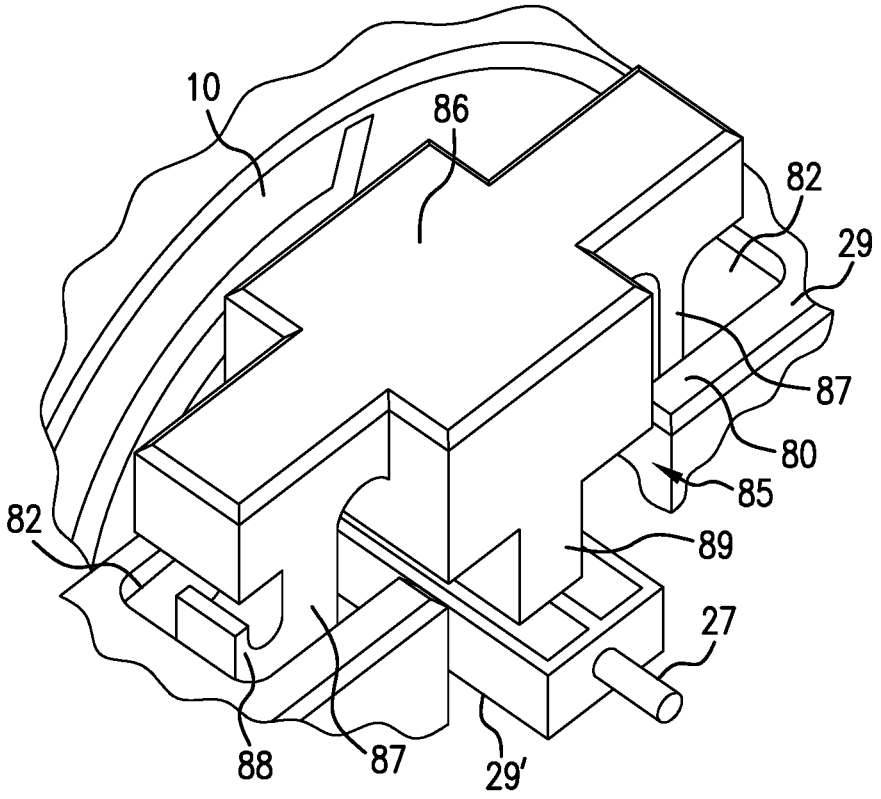
FIG. 13 shows a locking mechanism for securing a flywheel on the frame shown in FIG. 12 for forming a toy building element as shown in FIG. 11.

FIG. 12 shows a frame 80 and a connecting structure 23 which, in combination with a flywheel 10 and a snap element 80, forms the toy building element 20 as shown in FIG. 1. FIG. 13 shows how the snap-element 85 enables an easy way to assemble a toy building element 20 by the snap element 85 being inserted into recesses 82 in the frame 80 for retaining a shaft 27 of a flywheel.

The snap-element 80 constitutes an x-shaped block 86. Correspondingly the recesses 82, in the frame, have a complementary x-shape. The block 86 has a pivot 89 configured for retaining the shaft 27 against a bearing 29 for the shaft 27 in the frame 80.

Locking protrusions 88 are formed on arms 87 that extend in the same direction as the pivot 89. The locking protrusions are configured for locking with complementary means (not shown) in the recesses 82 in the frame 80.

A recess 82 is formed on the frame 80 to each side of the flywheel 10 as will appear from FIGS. 11 and 12.

In FIG. 13, the snap element 80 is shown in a position where it is not pushed down into the recess 82 in the frame. When the snap element 80 is pushed down into the recess as shown in FIGS. 11 and 2, it is locked firmly.

In FIG. 14, another toy building element 40 is shown. That toy building element is configured for being able to interconnect a further toy building element in the form of a human-like FIG. 90 and the toy building element 20 having flywheel 10. Moreover, the figure illustrates yet another type of complementary coupling means.

The toy building element 40 comprises an upper flange 45 with a protrusion 46 and a lower flange 47 with a back-stop protrusion 48 in the form of a flange formed at right angles on the lower flange 47. Flanges 45, 47 and protrusions 46, 48 are configured for being able to engage with a foot-like element 92 of the leg 91 of the human-like FIG. 90. On the fore edge of the foot 92, a protrusion 94 may be provided which is configured for coming into engagement with the protrusion 46. The hold-back protrusion 48 is configured for seizing around the rear side of the foot 92. Thereby the human-like figure may be retained releasably on the toy building element 40. A corresponding coupling mechanism may conceivably be formed directly between a toy building element 20 having flywheel 10 in combination with any of the above-referenced embodiments.

Figure 16:
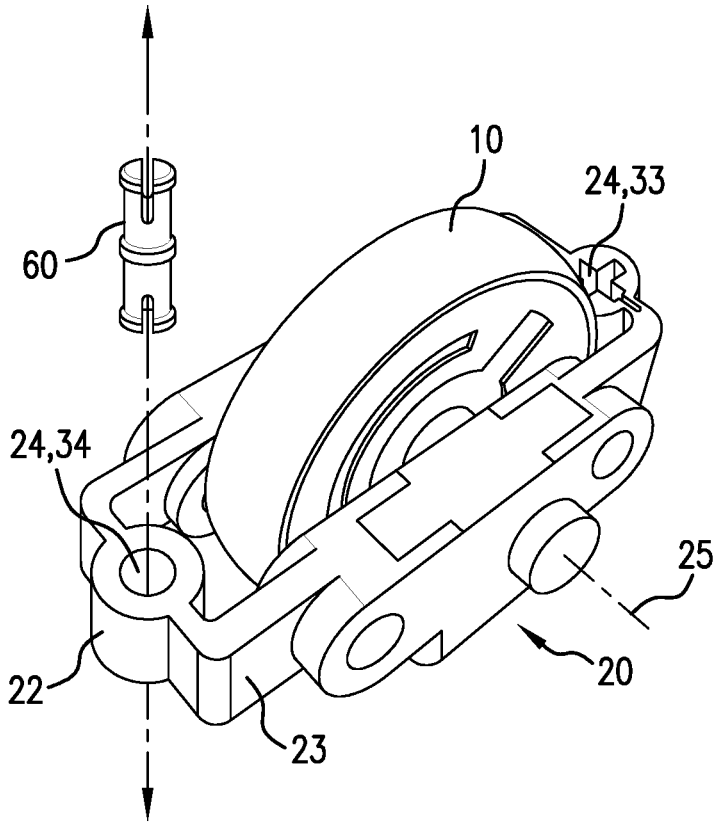
FIG. 16 shows yet an embodiment of the toy building element according to the invention with coupling means for another toy building element via two different types of mini-building elements.

Besides, the toy building element 40 of FIG. 14 comprises a coupling means 44 in the form of a cylindrical, through-going hole 44. Thereby eg coupling by means of a mini-building element 60 is enabled, as was described in the context of FIG. 9, to a through-going cylindrical hole 24, 34 on a building-element coupling part 22, as shown in FIG. 16.

Such interconnection will allow that the human-like FIG. 90 or another toy building element 40 can be coupled rotatably to the toy building element 20 having flywheel 10. By suitable choice of dimensions and materials, the friction in the coupling can be adjusted to the effect that the two toy building elements retained thereby can be manipulated to different mutual positions by a child at play.

Figure 17:
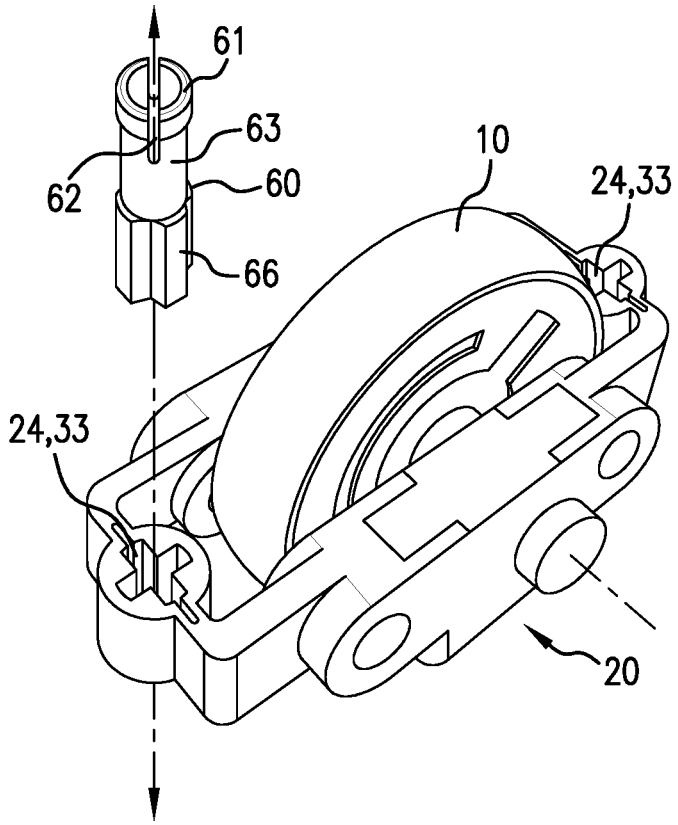
FIG. 17 shows a toy building element as shown in FIG. 11 with an alternative type of mini-building element for coupling of another toy building element and/or a shell part.

FIG. 17 shows how a turnable connection can be accomplished by means of a mini-building element 60 that is formed by a combination of the mini-building element 60 of FIG. 9 and the mini-building element 60 of FIG. 11. That mini-building element also enables a turnable connection between the toy building elements 20, 40, 90.

What is claimed is:

1. A toy building set comprising at least two toy building elements, a first toy building element provided with at least one or more coupling means of a first type, and a second toy building element provided with one or more coupling means of the first type and one or more coupling means of a second type, wherein said coupling means of the second type are configured to be complementary to said coupling means of the first type to the effect that they can be interconnected to form a structure such that the second toy building element can be mounted on the first toy building element in two or more different positions;

wherein the second toy building element comprises a connecting structure; a building-element coupling part, the building-element coupling part having four sides and being laterally connected via a side of one of the four sides to the connecting structure, the building-element coupling part comprising said one or more coupling means of the first type on a top surface thereof and said one or more coupling means of the second type on a bottom surface thereof; and a flywheel having an axle member;

wherein the connecting structure has a frame that encloses an inner region, and has a bearing therein for receiving the axle member of the flywheel which is rotatably mounted on the bearing, the frame of the connecting structure extending from a position on an axis of rotation of the flywheel, past the periphery of the flywheel to the building-element coupling part in a plane coinciding with a plane through the axis of rotation of the flywheel; and wherein the flywheel comprises at least one actuator mechanism in the form of a toothed wheel which is functionally connected to the flywheel at a substantially perpendicular angle to a top surface of the building-element coupling part, wherein the toothed wheel is configured to engage with an actuator means, in the form of a rack, to the effect that the toothed wheel can transmit movement from rack to flywheel, whereby the flywheel is caused to rotate freely.

2. A toy building set according to claim 1, wherein the connecting structure comprises positioning means for positioning the rack against the toothed wheel.

3. A toy building set according to claim 1, wherein the flywheel is coupled to two toothed wheels.

4. A toy building set according to claim 1, wherein the toothed wheel is connected to the flywheel in a rotation-resistant manner whereby the rotation force of the toothed wheel is transmitted to the flywheel.

5. A toy building set according to claim 1, wherein the toothed wheel and the flywheel are securely connected to each other via the axle.

* * * * *